US010231063B2

(12) United States Patent
Nikles et al.

(10) Patent No.: US 10,231,063 B2
(45) **Date of Patent: *Mar. 12, 2019**

(54) BINAURAL HEARING AID SYSTEM

(71) Applicant: SIVANTOS PTE. LTD., Singapore (SG)

(72) Inventors: Peter Nikles, Erlangen (DE); Juergen Reithinger, Neunkirchen am Brand (DE); Homayoun Kamkar-Parsi, Erlangen (DE); Eghart Fischer, Schwabach (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

This patent is subject to a terminal disclaimer.

(21) Appl. No.: 15/696,741

(22) Filed: Sep. 6, 2017

(65) Prior Publication Data

US 2018/0007478 A1 Jan. 4, 2018

Related U.S. Application Data

(63) Continuation of application No. PCT/EP2016/055188, filed on Mar. 10, 2016.

(30) Foreign Application Priority Data

Mar. 13, 2015 (EP) ..... 15159071

(51) Int. Cl.
*H04R 25/00* (2006.01)

(52) U.S. Cl.
CPC ..... *H04R 25/552* (2013.01); *H04R 25/407* (2013.01); *H04R 25/554* (2013.01); (Continued)

(58) Field of Classification Search
None
See application file for complete search history.

(56) References Cited

U.S. PATENT DOCUMENTS 9,253,581 B2 2/2016 Aubreville et al.
9,253,582 B2 2/2016 Nikles et al.
(Continued)

FOREIGN PATENT DOCUMENTS

CN 103387357 A 11/2013
DE 102013204681 A1 10/2014
(Continued)

OTHER PUBLICATIONS

Maxim Technical Writing Staff, "Resolving Magnetic Issues with Pulse Transformers", Maxim—Design Support—Technical Documents—Application Notes—Metering and Measurement Markets—Application Note APP 5471, Sep. 17, 2012 (Sep. 17, 2012), pp. 1-19, URL: http://pdfserv.maximintegrated.com/en/an/AN5471.pdf, [retrieved from the internet on Aug. 11, 2016], XP055294926.

*Primary Examiner* — Curtis A Kuntz
*Assistant Examiner* — Qin Zhu
(74) *Attorney, Agent, or Firm* — Laurence A. Greenberg; Werner H. Stemer; Ralph E. Locher

(57) ABSTRACT

In a binaural hearing aid system audio signals are transmitted between an antenna facility of a left ITE hearing aid and an antenna facility of a right ITE hearing aid. Binaural beam forming is based on a natural directivity of the pinna and/or based on a head shadowing effect. Each antenna facility has an antenna arrangement with a coil core made of magnetically permeable material, and extending along a longitudinal axis, a further electric hearing aid component, which emits electromagnetic interference radiation, and an at least partially planar shield made of magnetically permeable material. The shield is arranged between the antenna arrangement and the further hearing aid component transversely to the longitudinal axis of the coil core and the shield is arranged at a distance of 50 to 150 micrometers from the coil core, preferably 75 to 100 micrometers.

16 Claims, 10 Drawing Sheets

(52) U.S. Cl.
CPC ..... *H04R 25/65* (2013.01); *H04R 2225/025* (2013.01); *H04R 2225/49* (2013.01); *H04R 2225/51* (2013.01)

(56) References Cited

U.S. PATENT DOCUMENTS

| | | | | |
|---|---|---|---|---|
| 9,473,860 | B2 | 10/2016 | Fischer et al. | |
| 9,516,436 | B2 | 12/2016 | Nikles | |
| 9,521,494 | B2 * | 12/2016 | Nikles | H01Q 1/22 |
| 2003/0031339 | A1 | 2/2003 | Marshall et al. | |
| 2012/0093324 | A1 * | 4/2012 | Sinasi | H01Q 1/273 381/23.1 |
| 2013/0195296 | A1 | 8/2013 | Merks | |
| 2014/0348359 | A1 | 11/2014 | Woods | |
| 2014/0363037 | A1 | 12/2014 | Nikles | |
| 2015/0043763 | A1 * | 2/2015 | Troelsen | H01Q 1/273 381/315 |
| 2015/0244065 | A1 * | 8/2015 | Lim | H01F 27/36 343/718 |

FOREIGN PATENT DOCUMENTS

| | | | |
|---|---|---|---|
| DE | 102013207149 | A1 | 11/2014 |
| DE | 102013209062 | A1 | 11/2014 |
| EP | 2894880 | A2 | 7/2015 |

* cited by examiner

BINAURAL HEARING AID SYSTEM

CROSS-REFERENCE TO RELATED APPLICATION

This application is a continuation, under 35 U.S.C. § 120, of copending international application No. PCT/EP2016/055188, filed Mar. 10, 2016, which designated the United States; this application also claims the priority, under 35 U.S.C. § 119, of European patent application EP 15159071, filed Mar. 13, 2015; the prior applications are herewith incorporated by reference in their entirety.

BACKGROUND OF THE INVENTION

Field of the Invention

The invention relates to a binaural hearing aid system comprising a left ITE (in the ear) hearing aid and a right ITE hearing aid. More specifically, the invention relates to a binaural hearing aid system comprising a left CIC (completely in canal) hearing aid and a right CIC hearing aid. The invention deals with the problem of a directional processing of audio signals from a left hearing aid and a right ITE hearing aid each of them comprising one single microphone.

Generally, a hearing aid is used to supply a hearing-impaired person with acoustic ambient signals which are processed and amplified in order to compensate for or treat the respective hearing impairment. It consists, in principle, of one or more input signal converter (or input transducer), a signal processing facility, an amplifier and an output signal converter (or output transducer). The input transducer is generally a sound receiver, e.g. a microphone, and/or an electromagnetic receiver, e.g. an induction coil. The output transducer is usually implemented as an electro acoustic converter, e.g. a miniature loudspeaker, or as an electromechanical converter, e.g. a bone conduction earpiece. It is also referred to as an earpiece or receiver. The output transducer generates output signals, which are routed to the ear of the patient and are to generate a hearing perception in the patient. The amplifier is generally integrated into the signal processing facility. Power is supplied to the hearing aid by means of a battery integrated in the hearing aid housing. The essential components of a hearing aid are generally arranged on a printed circuit board as a circuit substrate and/or are connected thereto.

Hearing aids are known in various basic types. With ITE hearing aids (in the ear), a housing containing all functional components including microphone and receiver is worn at least partially in the auditory canal. CIC hearing aids (completely in canal) are similar to ITE hearing aids, but are however worn entirely in the auditory canal. With BTE hearing aids (behind the ear), a housing with components such as battery and signal processing facility is worn behind the ear and a flexible sound tube, also referred to as a tube, routes the acoustic output signals of a receiver from the housing to the auditory canal, where an earpiece on the tube is frequently provided to reliably position the tube end in the auditory canal. RIC-BTE hearing aids (receiver in canal, behind the ear) are similar to BTE hearing aids, but the receiver is nevertheless worn in the auditory canal and instead of a sound tube, flexible receiver tube routes electrical signals, instead of acoustic signals, to the receiver, which is attached to the front of the receiver tube, in most instances in an earpiece used for reliably positioning within the auditory canal. RIC-BTE hearing aids are frequently used as so-called open-fit devices, in which the auditory canal remains open for the passage of sound and air in order to reduce the distracting occlusion effect.

Deep-fit hearing aids (deep auditory canal hearing aids) are similar to the CIC hearing aids. While CIC hearing aids are however generally worn in a section of the outer auditory canal lying further out (distally), deep-fit hearing aids are moved (proximally) further toward the eardrum and are worn at least partially in the inner-lying section of the outer auditory canal. The outer-lying section of the auditory canal is canal lined with skin and connects the auricle to the eardrum In the outer-lying section of the outer auditory canal, which adjoins the auricle directly, this channel is formed from elastic cartilage. The channel from the temporal bone is formed in the inner-lying section of the outer auditory canal and thus consists of bones. The passage of the auditory canal between sections of cartilage and bone is generally angled at a (second) bend and describes a different angle from person to person. In particular, the bony section of the auditory canal is relatively sensitive to pressure and touch. Deep-fit hearing aids are worn at least partly in the sensitive bony section of the auditory canal. On being fed into the bony section of the auditory canal, they must also pass through the mentioned second bend, which may be difficult depending on the angle. Furthermore, small diameters and winding forms of the auditory canal may hamper the advance movement further.

In addition to the hearing aid types with an acoustic receiver to be worn on or in the ear, cochlea implants and bone conduction hearing aids (BAHA, bone anchored hearing aid) are also known.

It is common to all hearing aid types that the smallest possible housing or designs are sought in order to increase wearing comfort, if applicable to improve the implant ability and if applicable to reduce the visibility of the hearing aid for cosmetic reasons. The drive to identify the smallest possible design likewise applies to most other hearing aids.

Modern hearing aids exchange control data by way of a radio system which is usually inductive. The required transmission data rates with binaurally coupled hearing aids increase significantly if acoustic information is furthermore also to be transmitted for audiological algorithms (e.g., beam forming, side look, etc.). A higher data rate requires a greater bandwidth. One of the main determining factors with respect to the sensitivity of the transmission system to interference signals is precisely the bandwidth.

With the high and individual packing density precisely in ITE hearing aids, hearing-aid-internal interference signal sources form the main problem. If the bandwidth is enlarged, this intensifies the problem still further. With typical ITE hearing aids, the antenna is arranged on or partially in the so-called faceplate (the wall of the hearing aid facing away from the eardrum). The antenna is then typically in the direct vicinity of the so-called hybrid (hybrid integrated circuit substrate) and of the receiver. The hybrid and the receiver emit magnetic and electric fields, which can have an extreme influence on the transmission.

The arrangement of the antenna relative to the receiver and the hybrid is crucial to the performance of the transmission system. On account of the high packing density, a mutual shielding of the components is required. The hybrid is to this end typically encased with a shield box. The receiver obtains a shield film or is designed especially so that it is magnetically sealed.

Commonly assigned U.S. Pat. No. 9,516,436 B2 and its German published counterpart DE 10 2013 204 681 A1, proposes to arrange the antenna in the part of the hearing aid facing the eardrum instead of on the faceplate. A positioning is as a result achieved which reduces the influence of the transmission system by the hybrid and receiver.

Shown in a somewhat simplified way, the bridgeable distance is shortened for the transmission path with the same antenna and the same energy requirement but increased bandwidth. The antenna could however be manufactured more efficiently, but this is typically only guaranteed by increasing the antenna volume.

One possibility of improving the transmission path nevertheless consists in designing the antenna such that it uses a volume which would otherwise remain unused. Furthermore, the size of the antenna is increased and thus the efficiency increased, without also having to create more space in the hearing aid.

Directivity in hearing aids can be achieved by using two omnidirectional microphones or one directional microphone with two openings in one housing or—as introduced lately—by combining two directional microphones of a BTE (behind the ear) hearing aid binaurally, using a binaural audio link and binaural signal processing e.g. beam forming. Those methods are disclosed, for example, in commonly assigned U.S. Pat. No. 9,473,860 B2 and its German published counterpart DE 10 2013 209 062 A1, as well as in commonly assigned U.S. Pat. No. 9,253,581 B2 and its German published counterpart DE 10 2013 207 149 A1.

Although U.S. Pat. No. 9,253,581 B2 and DE 10 2013 207 149 A1 mention a binaural ITE hearing aid system, up to now it has not been possible to achieve directivity (which goes beyond natural directivity by the pinna) for CIC hearing aids because of the following reasons: There is no possibility of placing two omnidirectional or one directional microphone within the small diameter of the ear canal and the small volume of the CIC housing and there is no possibility of placing a wireless audio link arrangement including antenna for the required high data rate within the small volume of the CIC housing. Up to now there is no CIC product available offering directivity which goes beyond natural directivity by the pinna.

SUMMARY OF THE INVENTION

It is accordingly an object of the invention to provide a hearing aid system which overcomes the above-mentioned and other disadvantages of the heretofore-known devices and methods of this general type and which provides for a binaural ITE hearing aid system, in particular a binaural CIC hearing aid system, which offers directivity going beyond natural directivity given by the pinna.

With the foregoing and other objects in view there is provided, in accordance with the invention, a binaural hearing aid system, comprising:

a left ITE hearing aid with an antenna facility;

a right ITE hearing aid with an antenna facility;

means for transmitting audio signals between the antenna facility of said left ITE hearing aid and the antenna facility of said right ITE hearing aid and means for binaural beam forming based on at least one of a natural directivity of a pinna of a hearing aid wearer or a head shadowing effect;

each of said antenna facilities of said left and right ITE hearing aids including:

an antenna arrangement with a coil core made of magnetically permeable material and extending along a longitudinal axis;

a further electric hearing aid component configured to emit electromagnetic interference radiation;

an at least partially planar shield made of magnetically permeable material disposed between said antenna arrangement and said further hearing aid component, said shield being arranged transversely to the longitudinal axis of said coil core and at a spacing distance of 50 to 150 micrometers from said coil core. A preferred spacing distance measures between 75 and 100 micrometers.

In other words, the invention achieves the objects by a binaural hearing aid system, which includes a left ITE hearing aid with an antenna facility, a right ITE hearing aid with an antenna facility, means for transmitting audio signals between the antenna facility of the left ITE hearing aid and the antenna facility of the right ITE hearing aid and means for a binaural beam forming considering the natural directivity of the pinna and/or a head shadowing effect, wherein the antenna facility of each of the ITE hearing aids comprises an antenna arrangement with a coil core made of magnetically permeable material, and extending along a longitudinal axis, a further electric hearing aid component, which emits electromagnetic interference radiation, and an at least partially planar shield made of magnetically permeable material, wherein the shield is arranged between the antenna arrangement and the further hearing aid component, wherein the shield is arranged transverse to the longitudinal axis of the coil core and wherein the shield is arranged at a distance of 50 to 150 micrometers from the coil core, preferably 75 to 100 micrometers.

With a binaural ITE hearing aid system according to the invention, in particular, directivity with regard to the frontal direction (in relation to the user of the hearing aid) becomes possible because of the combination of an ITE hearing aid with the aforementioned antenna facility. The described antenna technique enables a wireless bi-directional audio signal transmission within the small diameter of the ear canal and, particularly, within the small volume of a CIC hearing aid housing. In a preferred embodiment of the invention the means for transmitting audio signals between the antenna facilities of the both hearing aids comprise in each of the hearing aids a transmission and receipt module coupled with the respective antenna facility for wireless transmission and receipt of audio signals. Advantageously, the transmission and receipt module comprises at least one of an amplifier, a frequency converter, a modulator, a demodulator, an encoder and a decoder.

The invention realizes that an ITE or a CIC hearing aid receives acoustic signals exhibiting a natural directivity provided by the pinna (resolving the front/back ambiguity especially for the higher frequencies) and also by head shadowing. These natural effects provided by the pinna and/or the head of the hearing aid user allow for use of the audio signals received by the hearing aids placed in the left and in the right ear as direct input signals for a binaural beam forming algorithm, i.e. without the need of a monaural directional processing done in BTE hearing aids as preprocessing for the binaural beam former.

Advantageously, the binaural hearing aid system further comprises means for an adaptive beam forming and/or means for noise reduction and/or means for head movement compensation. Preferably, all of these means are binaural processing means which process input signals of both ITE hearing aids. By comparing, for example, different (linear) combinations of the input signals of the left ITE hearing aid and of the right ITE hearing aid, it is possible to distinguish a target signal, e.g. a speech signal, from a noise signal. The binaural beam forming algorithm and/or the binaural noise reduction algorithm is then adapted or corrected accordingly. Particularly, a narrow beam direction (i.e. the directivity of the binaural hearing aid system achieved by the beam former) is rotated adaptively based on the direction of the target signal. This allows the user a normal and comfortable conversation without the need to always directly face the speaker. Preferably, also a binaural Wiener-type filter is used for noise reduction.

In yet another preferred realization of the invention, a frontal target signal is adaptively tracked in a certain angular range (e.g. +−10°) which compensates for unavoidable small head movements of the hearing aid wearer).

One mayor key aspect of the invention is the combination of a new antenna technique and the use of the natural directivity of the head and/or the pinna for a subsequent binaural beam forming algorithm. The invention thus enables directivity in ITE, particularly in CIC hearing aids.

According to yet another preferred embodiment the means for a binaural beam forming are adapted to process a left electric input signal received from a left input signal converter of the left ITE hearing aid and a right electric input signal received from a right input signal converter of the right ITE hearing aid both into a left electric output signal to be transmitted to a left output signal converter of the left hearing aid and into a right output signal to be transmitted to a right signal converter of the right ITE hearing aid, each of the input signal converters being adapted to convert acoustic input signals into said electric input signals, and each of the output signal converters being adapted to convert said electric output signals into acoustic output signal. Preferably, the means for a binaural beam forming comprise left beam-forming means located in the left ITE hearing aid and right beam forming means located in the right ITE hearing aid, the left and the right beam forming means both process the left and the right electric input signals and generate a left output signal and a right output signal respectively. For generating the output signal for the left ITE hearing aid also the input signal of the right ITE hearing aid is considered and vice versa.

In yet another preferred embodiment the electric input signals of both ITE hearing aids are converted for wireless transmission and are exchanged via a bidirectional data link established between the two antenna facilities of the both hearing aids.

Advantageously, the means for a binaural beam forming are further adapted to receive a left electric input signal from the left ITE hearing aid and a right electric input signal from the right ITE hearing aid, and to combine the left input signal and the right input signal to preserve a target signal and attenuate signals coming from directions different from the direction of the target signal, thereby taking into consideration the natural directivity of the pinna and/or the head shadowing effect. Preferably, the left and the right input signals are weighted before combining them, and the weights are being adaptively changed ensuring that the target signal remains nearly untouched or not attenuated. Particularly, the means for a binaural beam forming are adapted to adaptively track the direction of the target signal and to readjust the combination of the right input signal and the left input signal accordingly.

In another advantageous embodiment of the invention the left ITE hearing aid and the right ITE hearing both comprise means for a binaural beam forming. Preferably, both ITE hearing aids of the binaural system differ in its shape but comprise identical components. However, the invention also covers the embodiment that the means for a binaural beam forming or the processing means are located in only one of the both ITE hearing aids. In this case, the output signals for the ITE hearing aid that does not comprise the binaural beam forming or processing means are transmitted to the respective hearing aid using also the antenna facilities.

The antenna facilities used in the binaural hearing aid system each include an antenna arrangement with a coil core made of magnetically permeable material, and a further electric hearing aid component, which emits electromagnetic interference radiation, wherein an at least partially flat shield made of magnetically permeable material is arranged between the antenna arrangement and the further hearing aid component, and wherein the shield is arranged transverse to the longitudinal axis of the coil core at a distance of 50 to 150 micrometers relative to the coil core. The optimal distance results on the one hand such that with an increasing distance the signal-to-noise ratio of the antenna firstly increases and then reduces, with a maximum in the order of magnitude of 100 micrometers. On the other hand, the shield effect between the antenna and the further hearing aid component initially increases with an increasing distance, in order then to pass into saturation in the case of a distance of the order of magnitude of 100 micrometers. Furthermore, a minimal distance is to be retained on account of the overall installation size.

Transverse is understood here to mean an orientation at right angles or approximately at right angles or in an angular range of a few degrees about 90° relative to one another. In this way, on account of different housing shapes, the design of which is determined by the auditory canal, a specific tilt can be permitted between the antenna (or the coil core respectively) and the shield, for instance in an angular range of 45° about the transverse orientation. In this way a tilt relative to the transverse orientation disadvantageously reduces the sensitivity of the antenna.

The orientation relates here to the longitudinal axis of the antenna arrangement, i.e. the coil core, and the surface pro-video! by the shield. Generally, an antenna arrangement comprising a coil core and an electrically conductive coil wound around the coil core has a preferred transmit and receive spatial direction along the longitudinal axis of the coil core. The field density along this direction is much larger than along directions transverse to the longitudinal axis. The shield can either be a plate, or a u-shaped angular plate, or a type of bowl, into which the further hearing aid component can be placed. The planar shield effects on the one hand a shielding of the electromagnetic fields and already as a result reduces the mutual interference coupling. A high magnetic permeability increases the shielding effect. Furthermore, the shield, on account of the high permeability of the material, ultimately brings about an extension of the antenna or an increase in its efficiency. A higher transmit field strength and a higher receive sensitivity develop as a result.

An advantageous development of the basic idea consists in the material of the coil core having a lower magnetic permeability than the material of the shield. The higher magnetic permeability of the shield material amplifies the shield effect, without, on account of the typically higher loss angle of the highly permeable material, having a notable negative effect on the performance of the antenna.

A further advantageous development consists in the shield consisting of mu-metal film. The use of a conventional mu-metal film with its particularly high magnetic permeability can achieve good process ability at the same time as particularly good shielding.

A further advantageous development consists in the shield being glued to the antenna arrangement. This herewith gives rise to a particularly uncomplicated assembly.

According to another advantageous embodiment the further electric hearing aid component mainly emits the electromagnetic interference radiation in a spatial interference radiation direction, and the antenna arrangement and the further hearing aid component are arranged transverse relative to one another such that coupling of interference radiation into the antenna arrangement is reduced. Mainly here means that the radiation intensity of the interference radiation in the interference radiation spatial direction is greater than in any other spatial direction. The smallest coupling is then produced if the two spatial directions are oriented at right angles to one another, such that by transverse is meant an orientation at right angles or approximately at right angles or in an angular range of a maximum of 45° greater or less than 90° relative to one another.

The orientation relates in more precise terms to the respective magnetic field, so that the respective fields are orientated transverse to one another and the respective magnetic fields likewise. In this way the main directions of the fields cannot be readily theoretically determined, so that the respective main direction is not clearly fixed. Furthermore, a minimal tilt relative to the transverse orientation on account of the thus caused asymmetry of the fields can have an advantageous effect on the shielding between the component and antenna. The optimal orientation of the component results, theoretically in this respect, at 90° but must however be determined individually depending on the component and its actual field. A tilting of the component basically has a less disadvantageous or indeed advantageous effect in comparison with a tilting of the shield, so that larger tilts of the component would generally be provided irrespective of the shield.

The reduction in the interference couplings into the antenna arrangement enables a greater transmit and receive bandwidth while retaining the structural volume and energy requirement. The further hearing aid component may be a receiver or any other component emitting in particular inductive or electromagnetic radiation.

An advantageous development of the basic idea consists in the antenna arrangement including a coil antenna, in the further hearing aid component including a coil arrangement which emits the interference radiation, and in the coil antenna and the coil arrangement being oriented transverse to one another with respect to their respective longitudinal direction, in other words at right angles or approximately at right angles, or in an angular range about 90°. The magnetic field of a coil antenna has a distinct spatial orientation, so that a distinct reduction in the mutual interference coupling is achieved by the alignment transverse to one another.

A further advantageous development consists in the further hearing aid component being arranged on the shield. The arrangement of the hearing aid component close to the antenna arrangement with a reasonably low mutual interference coupling is enabled in particular by the mutual shielding. A space-saving arrangement is produced as a result, which is furthermore also suited to the preassembly of the antenna arrangement and the further hearing aid component.

In yet another preferred embodiment the further hearing aid component is fastened on the shield. The fastening of the hearing aid component on the shield forms a preassembled module together with the antenna arrangement. The further assembly or manufacture of the hearing aid is simplified as a result.

A further advantageous development consists in the shield, at least in an area of its periphery, surrounding the further hearing aid component in the direction facing away from the antenna core. The efficiency of the shield is as a result further increased and the interference coupling in particular of the further component into the antenna arrangement is further reduced. Furthermore, the sensitivity and the quality of the antenna increase as a result.

A further advantageous development consists in the further hearing aid component being a receiver and the coil core and the shield having a sound channel which passes through the coil antenna. In the case of an ITE hearing aid, both components can thus be positioned in a space-saving manner as deeply as possible in the auditory canal. An acoustically advantageous positioning of the receiver as close as possible to the eardrum is achieved; while the coil antenna close to the ITE hearing aid of the respective other (right or left) ear of the user is achieved, thereby positively influencing the quality of the mutual data transmission. It has been shown practically that the sound channel does not significantly impair the antenna properties in the relevant field strength range.

The receiver is an electrodynamic converter and thus the receiver contains a magnetic circuit which has an excitation winding. During operation, the receiver is typically fed with a pulse-density-modulated signal, which has spectral components in the frequency band of the data transmission system. This actuation is very energy-efficient and is therefore used in hearing aids. The spectral components cannot be avoided without strongly increasing the energy requirement of the hearing aid. The receiver is the largest consumer in the hearing aid. Contrary to this, the energy requirement of the data transmission system is to this end very small and accordingly its receive sensitivity relative to magnetic interferers is relatively large.

By arranging the receiver transverse to the antenna, the magnetic circuit and thus also the receiver winding is aligned at right angles or approximately at right angles or in an angular range about 90° relative to the antenna. The coupling of the receiver winding to the antenna is thus significantly reduced. The antenna can as a result be positioned significantly closer to the receiver.

The combination of the transverse-lying receiver with the antenna is optimized for the tapering shell contour at the tip of the ITE hearing aid and the installation length is thus minimized. The positioning at the tip of the ITE hearing aid increases the adjustment rate and reduces the size of the hearing aid. In addition, more degrees of freedom are enabled when positioning the faceplate, since the antenna is no longer arranged on or close to the faceplate. Furthermore, the effort involved in planning a suitable position of the antenna on or close to the faceplate is omitted, since the tip of the ITE hearing aid represents a position which was predetermined in advance. In this way there is also no need to take physical restrictions into account, e.g. of magnetic field interferences, which is required when positioning in the region of the faceplate.

Since the receiver winding is not arranged centrally with respect to the receiver, which is usually not possible in terms of structure, and since the housing slightly deforms the field lines, an interference coupling is still produced in the event of very close proximity to the antenna. The interference coupling on the antenna can be reduced by the additional shielding between the antenna and the receiver. The shielding preferably covers (best space/performance ratio) the entire surface of the receiver. The field lines of the excitation winding of the receiver are fed back in a concentrated manner on account of the shield arranged in the immediate proximity at a minimal distance from the antenna core, so that only a very small number of field lines passes through the antenna windings. This prevents current from being induced into the antenna winding and thus interference couplings from the receiver are significantly reduced. The shielding renders additional measures, for instance shielding films, and their installation, unnecessary.

The combination of shield and coil core is not only used for shielding purposes, but also in addition increases the sensitivity of the antenna. On account of the effect of the shield, the antenna length could therefore be reduced while retaining the same sensitivity.

A further advantage of the shield in the joint arrangement with the antenna is that with the same inductance, the required winding rate can be reduced so that in turn the diameter of the individual winding, typically enameled copper wire, can be increased. The minimal number of windings and the larger wire diameter advantageously reduce the electrical winding resistance, as a result of which the antenna quality is increased.

In order to increase the interference decoupling, the shield can also still extend around the edges of the receiver. All four edges of the receiver and their permutations are conceivable here for and bring about a more or less large intensification of the decoupling effect. The receiver could be encased laterally or even entirely in order to further improve the shield effect. The antenna sensitivity and quality are herewith also further improved.

The field line concentration and thus the field strength of the antenna reduce on account of the shield at the exit to the receiver. The minimal field strength causes fewer eddy currents in the metal surface of the receiver, and the quality of the antenna increases as a result. The distance between the antenna and the receiver can therefore be shortened while retaining the same quality. This effect intensifies further on account of the hole in the ferrite, since the field lines concentrate at the edge in the flange area.

A further advantageous development of the basic idea consists in the coil core having a sound channel and the shield having a sound opening, and in the sound channel and the sound opening being arranged flush such that a continuous sound channel is formed. The sound channel enables in particular a receiver to be provided as a further hearing aid component. The acoustic output signal of the receiver can then be routed directly into the sound channel. The acoustic output signal of a receiver arranged at another site can naturally also be routed through the sound channel if the further hearing aid component is not a receiver. It is as a result particularly unnecessary to provide a separate sound channel, so that a further space requirement is avoided.

A further advantageous development consists in the inner wall of the sound channel and/or the side of the shield facing away from the coil core being covered with sound-damping material. The sound damping effects a vibration decoupling which is advantageous for the use of the receiver. By the sound damping being integrated into the module comprising coil core, coil antenna and receiver, a continuous preassembly and thus a continuous simplification of the further assembly and manufacture of the hearing aid is achieved. Furthermore, the distance, which is effected by the sound damping between the receiver and the shield, brings about the decoupling from the shield and receiver at a distance which is required in order to increase the antenna quality, by the transfer of the antenna field into the receiver being reduced by the distance. In this way, the more the receiver is surrounded by the shield, the smaller the distance can be selected, without a reduction occurring in the antenna quality.

As explained previously, a basic idea behind the invention consists in configuring the antenna such that it can be positioned closer to a further hearing aid component, without therefore losing out on performance. To this end, an antenna facility is specified, which integrates the different functions, for instance shielding, contacting etc. in a small space. The arrangement makes it possible in particular to manage without an additional space requirement and without additional components.

Furthermore, the antenna can also be positioned very close to the hearing aid component, and combined as an integrated module. The installation is simplified as a result. The arrangement of the receiver relative to the antenna is fixedly predetermined and only one, instead of two, components is present. No separate work steps are required for the installation of the antenna. Nor are any additional components required for a separate assembly. Instead, the antenna module is a part which is already automatically pre-assembled prior to manufacture.

Other features which are considered as characteristic for the invention are set forth in the appended claims.

Although the invention is illustrated and described herein as embodied in a binaural hearing aid system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
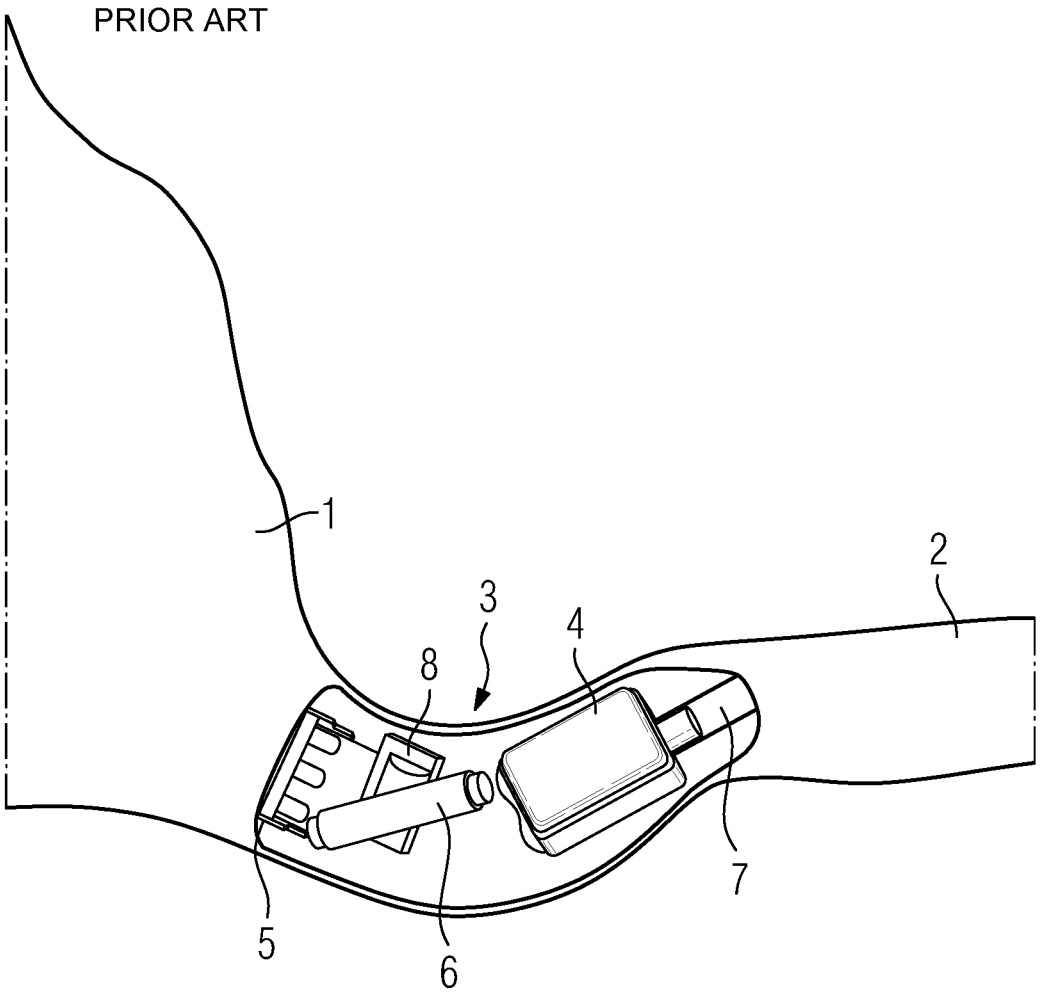
FIG 1 PRIOR ART
FIG. 1 shows a prior art ITE hearing aid.

Referring now to the figures of the drawing in detail and first, particularly, to FIG. 1 thereof, there is shown a schematic representation of an ITE hearing aid according to the prior art. The ITE hearing aid 3 is inserted into the outer auditory canal of the hearing aid wearer. It is partly disposed in the outer-lying cartilaginous part 1 of the auditory canal and is partially pushed into the bony part of the auditory canal. This is consequently a CIC hearing aid. Depending on how far the hearing aid is introduced into the auditory canal, it could also be a deep-fit hearing aid.

A receiver 4 is placed on the end oriented toward the eardrum in the hearing aid 3. The receiver outputs acoustic signals to the eardrum via a sound channel 7. A hybrid circuit substrate 8 is arranged on the faceplate arranged on the opposing end, said circuit substrate including a signal processing facility (not shown) and an amplifier for generating control signals for the receiver 4. An antenna 6 is likewise arranged and aligned on the faceplate 5 such that it is oriented in the direction of the opposing ear (not shown) of the hearing aid wearer. The antenna 6 is used to transmit data between the two binaural hearing aids of the hearing aid wearer, wherein only one of the two hearing aids is shown.

It is apparent that the antenna is arranged relatively close to the further electronic components of the hearing aid 3, so that electromagnetic interference signals herefrom can be coupled into the antenna 6. Interference signals of this type are in particular emitted by the receiver 4, which has an inductive receiver coil, which is used to convert electrical signals into acoustic signals.

In addition, the signals which the antenna 6 sends or receives must pass the receiver 4 on their way to the opposing ear or hearing aid of the hearing aid wearer, which also negatively influences the data transmission path. The cited interference factors severely reduce the performance of the data transmission system, so that a high bandwidth can only be achieved to a restricted degree with at the same time a minimal energy requirement.

Figure 2:
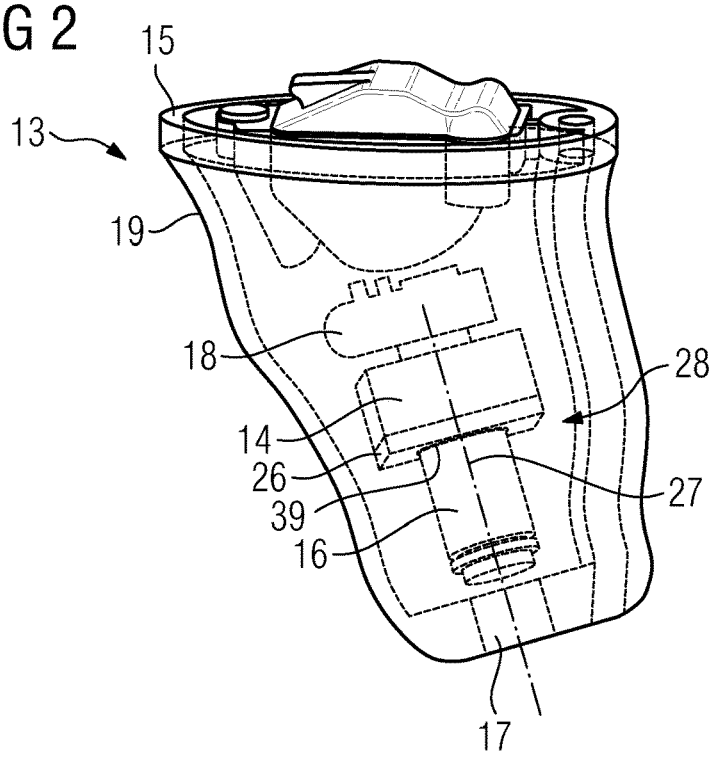
FIG. 2 shows an ITE hearing aid according to the invention with an antenna facility.

FIG. 2 shows a schematic view of an ITE hearing aid 13 with an antenna facility 28. The housing 19 of the ITE hearing aid 13 is tapered towards the eardrum. A sound channel 17 on this side is used to emit acoustic signals toward the eardrum of the wearer.

The hearing aid 13 is sealed by a faceplate 15 on the opposing side, on which faceplate, in addition to a battery (not shown) and microphones (likewise not shown), a hybrid circuit substrate 18 (shown with a dashed line) is arranged in the inside of the hearing aid 13 or of its housing 19. The hybrid circuit substrate 18 includes a signal processing facility and an amplification facility, which actuates the receiver 14 which is likewise arranged inside the housing 19. The receiver 14 generates acoustic output signals, which are output by way of the sound channel 17.

The receiver 14 is oriented transverse to the longitudinal axis of the hearing aid 13. The antenna 16 is disposed between the receiver 14 and the tapered end of the hearing aid 13 oriented towards the eardrum, in order to transmit data between the two binaural hearing aids of the hearing aid wearer. The antenna 16 is oriented in the longitudinal direction of the hearing aid 13 and is thus aligned transverse to the receiver 14. It is separated from the receiver 14 by a shield 26. The shield 26 is arranged transverse to the antenna 16 or in other words transverse to the longitudinal axis 27 of its coil core (not shown) and at a minimal distance thereto. It has a sound opening 39, which is arranged flush with the sound channel 17. The distance amounts to between 50 and 150 micrometers. The antenna 16, the coil core, the receiver 14 and the shield 26 form an antenna facility 28.

The transverse alignment of the receiver 14 effects a space-saving arrangement of the receiver 14 and antenna 16, the overall length of which is reduced by the transverse arrangement of the receiver 14. In addition, the transverse arrangement of the receiver 14 produces an improved utilization of space in the tapering part of the housing 19. The space available in the tapered tip of the housing 19 is utilized better than would be the case with a longitudinally arranged receiver. In the event that the sound output of the housing 19 does not follow a straight line with the sound channel 17 in the antenna 16, then a curved pre-formed sound tube which leads to the sound exit is connected to the antenna 16 on the output side.

Figure 3:
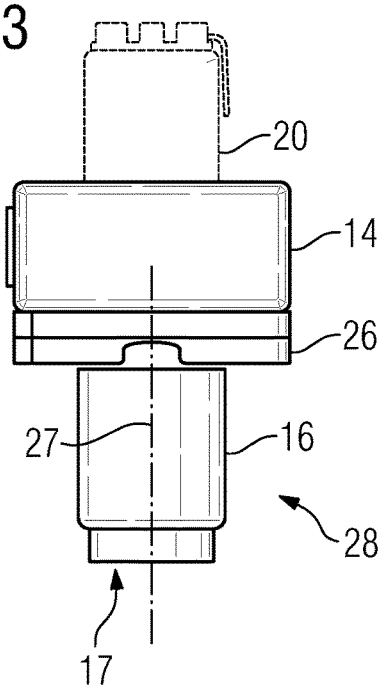
FIG. 3 shows a schematic representation of the antenna facility.

FIG. 3 again shows a schematic representation of the antenna facility 28. The sound channel 17 is disposed within the antenna 16 and runs through this to the receiver 14. The receiver 14 is, as explained previously, oriented transverse to the antenna 16 and to the longitudinal direction of the ITE hearing aid. The shield 26 is arranged transverse to the longitudinal axis 27 between the coil core (not shown) of the antenna 16 and the receiver 14 at a distance of 50 to 150 micrometers from the coil core. The distance can be effected for instance by a premolded part, upon which the shield 26 and the antenna 16 are mounted. The distance can also be affected in a particularly simple manner in that the shield 26 and antenna 16 are glued to one another by means of an adhesive layer of a suitable thickness.

A longitudinally arranged receiver 20 is shown with a dashed line for explanation purposes only. The dashed arrangement of the receiver 20 illustrates that the overall length increases with a longitudinal arrangement of the receiver 20, thereby not at the same time producing a tapering contour of the arrangement. As explained previously, it is illustrated such that with a longitudinal arrangement of the receiver 20, the space cannot be utilized so well in the tapered tip of the hearing aid 13.

Figure 4:
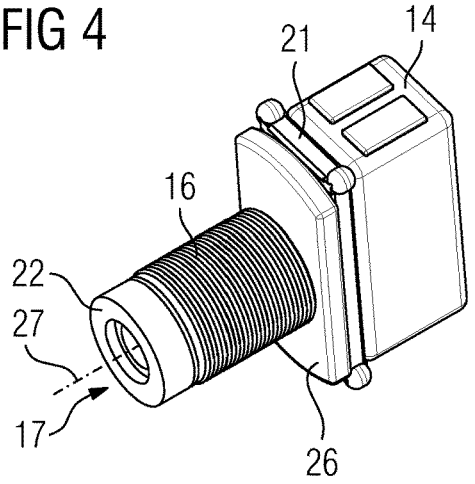
FIG. 4 shows an antenna receiver module.

FIG. 4 shows a perspective view of an antenna receiver module. The receiver 14 is, as explained previously, oriented transverse to the antenna 16. The antenna 16 is arranged on a coil core 22 which consists of permeable material. The permeable coil core 22 is used, in a conventional manner, to increase the antenna surface or sensitivity.

The shield 26 is arranged (the distance is not recognizable in the figure) at a distance of 50 to 150 micrometers from the end of the coil core 22 facing toward the receiver 14. The shield 26 is predominantly planar in shape and oriented transverse to the alignment of the antenna 16, in other words transverse to the longitudinal axis 27 of the coil core 22 and in parallel to the alignment of the receiver 14. The surface of the shield 26 is dimensioned such that the receiver 14 is entirely or almost entirely shielded from the antenna across the entire surface facing the shield 26 by means of the shield 26, or conversely the antenna 16 is shielded from the receiver 14.

The sound channel 17 runs through the coil core 22 and through the shield 26 to the receiver 14. The coil core 22 is covered on the inside by a sound-damping or vibration-damping material which is molded as a tube 21. In an alternative embodiment, the coil core 22 does not need to be covered in a vibration-damping manner on the inside and would then be used as a per se undamped sound guidance. A larger cross-section of the sound tube can thus be achieved. The tube 21 surrounds the sound channel 17 from the antenna-side exit toward the receiver 14 and is molded there in a planar fashion in parallel to the shield 26. The receiver 14 is attached to the planar-shaped part of the tube 21 and is thus likewise vibration-insulated. Round extensions of the sound-damping or vibration-damping material are used for the vibration-decoupled suspension of the facility in the housing of the hearing aid, said facility also being integrated into the facility.

The coil core 22 forms an antenna receiver module, together with the tube 21, the antenna 16, the shield 26, and the receiver 14. The tube 21 can be molded such that with arrangements of the shield 26 and the coil core 22 on the tube 21, the distance mentioned above results between the shield 26 and the coil core 22. The module can be inserted into the hearing aid pre-installed or preassembled. The pre-assembly of the antenna receiver module on the tube 21 reduces the assembly outlay during manufacture of the hearing aid and thus simplifies the manufacturing process.

Figure 5:
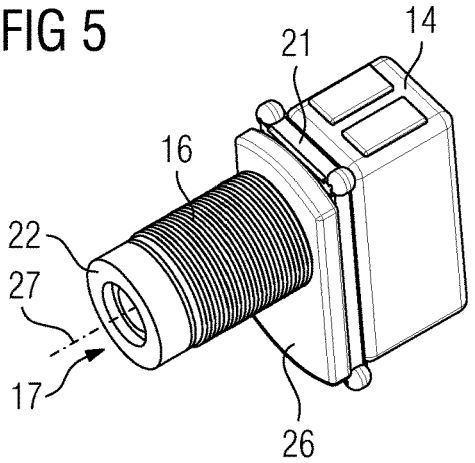
FIG. 5 shows an antenna receiver module with an offset antenna.

FIG. 5 shows an embodiment similar to the preceding representation. In this respect, the same reference characters are used for the same components and reference is made to the preceding explanations. Contrary to the embodiment mentioned above, the coil core 22 and antenna 16 is however not arranged centrally with respect to the shield 26, but is displaced (upward in the figure). This can be used to adjust the outer shape of the antenna 16 and receiver 14 to the assembly space available in a hearing aid.

Figure 6:
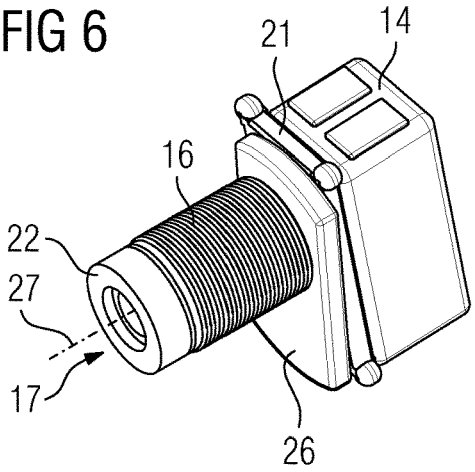
FIG. 6 shows an antenna receiver module with a tilted receiver.

FIG. 6 shows a further embodiment similar to the preceding representations. The same reference characters are in turn used and reference is made to the preceding explanations. Contrary to the embodiment mentioned previously, the receiver 14 is tilted relative to the shield 26. This can also be used for adjustment to the assembly space available in a hearing aid. Depending on the alignment of the dynamic fields of the receiver 14 and antenna 16, the shielding effect of the shield 26 can vary with a minimal tilting angle of the receiver 14, and in certain circumstances can even be improved compared with an exactly perpendicular arrangement.

Figure 7:
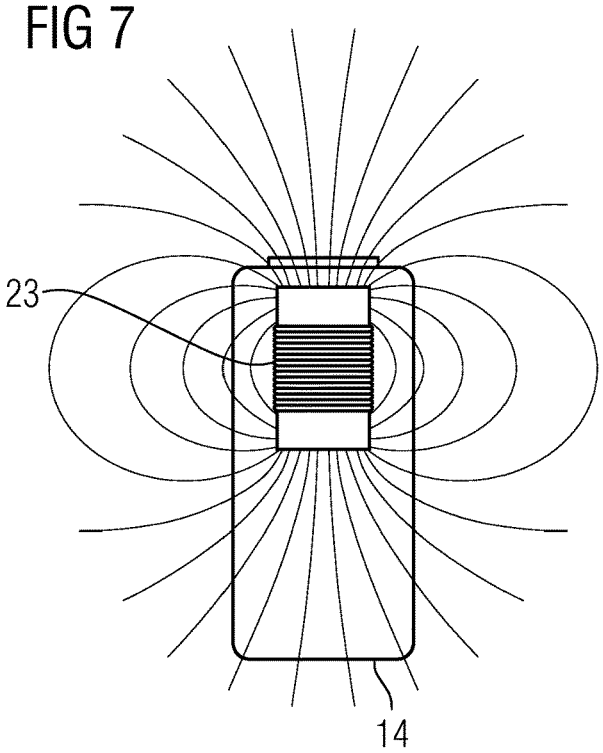
FIG. 7 shows a field line curve of the receiver.

FIG. 7 shows a schematic and significantly simplified representation of the field line curve of a receiver functioning with receiver coils. A receiver coil 23 is arranged axially in the receiver 14, in other words oriented in the longitudinal direction. It is apparent that the receiver coil 23 in the axial direction generates a very compressed (magnetic) field, while in the radial direction, in the figure in other words to the right and left, generates a relatively weak (magnetic) field. The field of the receiver 23 is generally however significantly influenced by its housing and possibly one or more further receiver coils and magnetic components and is formed in a more complex manner.

It is also apparent that the magnetic field, which the receiver 14 generates, is more strongly pronounced in its longitudinal direction than in its transverse direction. Consequently, the previously mentioned arrangement, in which the antenna which is sensitive to electromagnetic interference signals is, not arranged longitudinally but instead transverse to the receiver already brings about a significant decoupling of the electromagnetic signals of the receiver 14 from the said antenna. The improved decoupling is thus achieved in that the antenna is arranged both laterally from and also transverse to the receiver 14.

Figure 8:
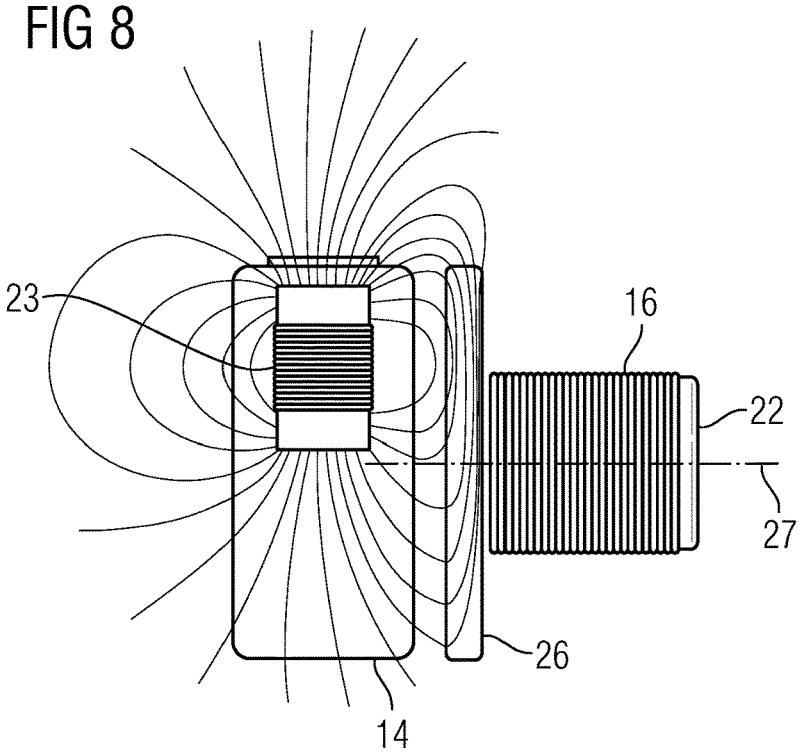
FIG. 8 shows the field line distribution of the receiver with shielding.

FIG. 8 shows the field line curve of the receiver with a shielding. The receiver 14 is arranged to the left in the figure on the previously cited shield 26 of the permeable coil core 22. On the other side of the shield 26, the marginally distanced coil core 22 explained above bears the antenna 16.

The field line curve shown illustrates the shielding of the antenna 16 from the receiver 14 or from the signals of the receiver coil 23. The field lines running in the direction of the antenna 16 are deformed by the shield 26 and run here through. The field line density in the shield 26 is thus increased, whereas the field line density on the other side of the shield 26 is as a result reduced at the same time. In other words, the strength of the (magnetic) field generated by the receiver coil 23 at the site of the coil 16 is reduced significantly. Interference couplings from receiver signals into the antenna 16 are thus significantly reduced.

Figure 9:
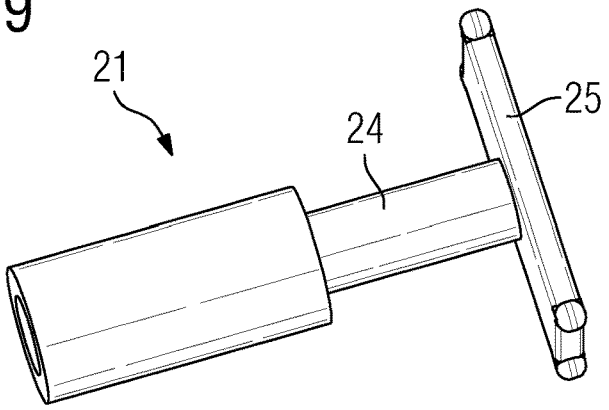
FIG. 9 shows a tube.

FIG. 9 shows the previously mentioned sound-damping tube separately. The tube 21 is passed through in the longitudinal direction by the sound channel. A coil section 24 is provided to receive the previously mentioned coil core 22. The coil core 22 is arranged around the coil section 24, if necessary also around the further longitudinal path of the tube 21. A shield section 25 is provided to receive the shield. The shield is placed here on the one side of the shielding section 25, whereas a receiver is arranged on the opposite side of the shield section 25. The illustrated tube 21 consists entirely of sound-damping material, for instance conventionally of Viton (a registered trademark of I.E. Du Pont de Nemours & Company).

Figure 10:
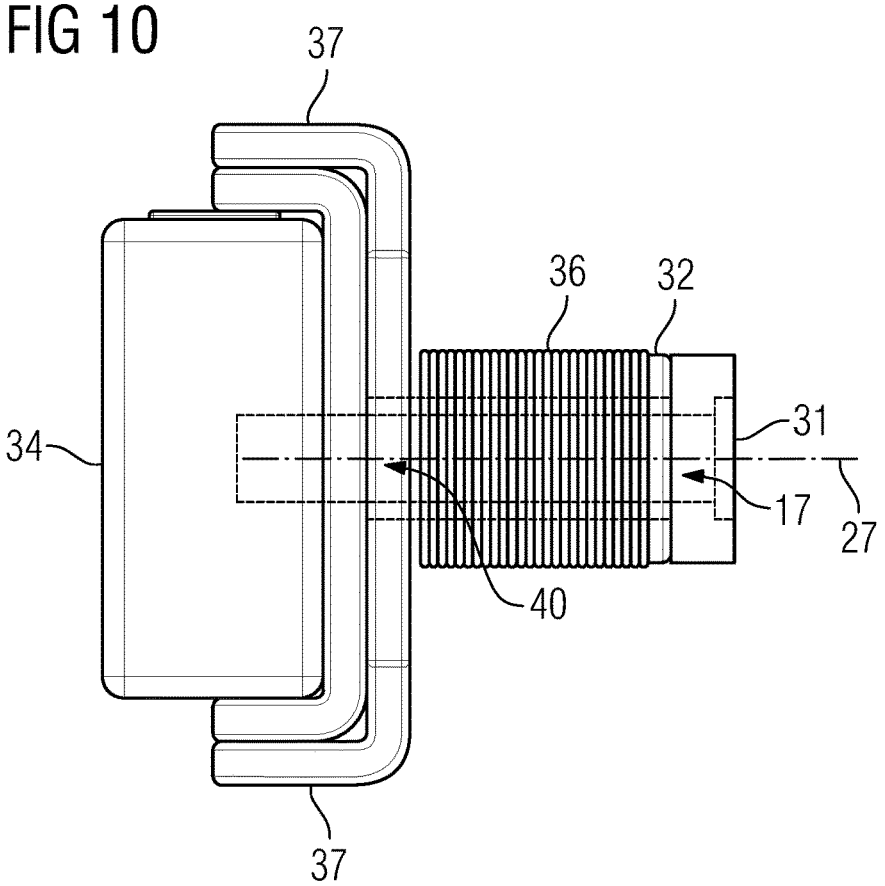
FIG. 10 shows an antenna receiver module.

FIG. 10 shows a further embodiment of the antenna-receiver module. At a distance of 50 to 150 micrometers from the coil core 32, a shield 37 is arranged, as explained above, on one side. An antenna 36 is wound onto the coil core 32. On the side facing away from the antenna 36, the shield 37 surrounds the receiver 34 arranged there at least in the region shown to the top and bottom in the figure. To this end, the shield 37 is embodied there in the shape of a bowl, so that the receiver 34 is surrounded by the shield 37 at least in a region of the shield periphery in the direction facing away from the antenna 36.

A particularly good shielding effect is given in case the shield 37 is surrounding the receiver 34 on all sides. A further improvement in the shielding can be achieved in that the shield 37 entirely encloses the receiver 34 and not just laterally. A further improvement in the antenna is produced as a result, which can either be used to increase the bandwidth or else to perform a shortening of the antenna with unvarying performance.

A sound channel 17 passes through the coil core 32, and thanks to the continuous tube 31 is covered with sound-damping material. The sound channel 17 is arranged flush with the sound opening 40 of the shield 37. The sound opening 40 and the sound channel 17 thus together form a continuous sound channel. The tube 31 is likewise embodied planar or bowl-shaped in the region of the shield 37 and receives the receiver 34 in a vibration-damping manner. The receiver 34 is attached to the tube 31. The receiver antenna module shown can be pre-assembled, so that the further assembly and manufacture of the hearing aid is significantly simplified.

Figure 11:
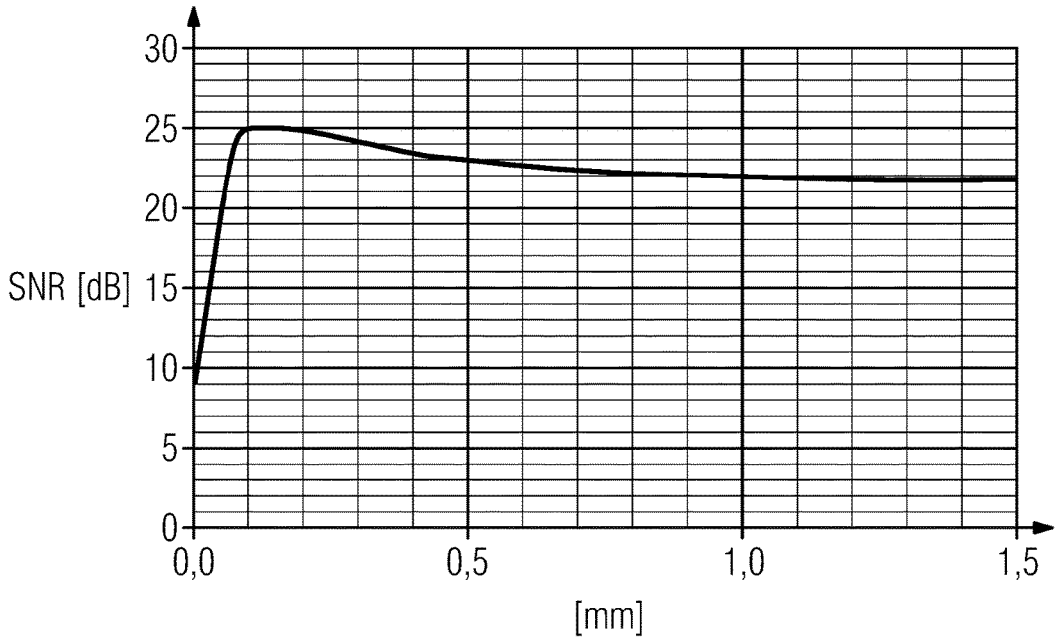
FIG. 11 shows the signal-to-noise ratio across the shielding distance.

FIG. 11 shows the curve of the signal-to-noise ratio (SNR) of the antenna signal as a function of the distance explained above between the shield and the coil core of the antenna. It is apparent that the signal-to-noise ratio is at its maximum at approximately 100 to 200 micrometers distance. It emerges from the curve that a certain minimum distance between the shield and coil core is advantageous.

Figure 12:
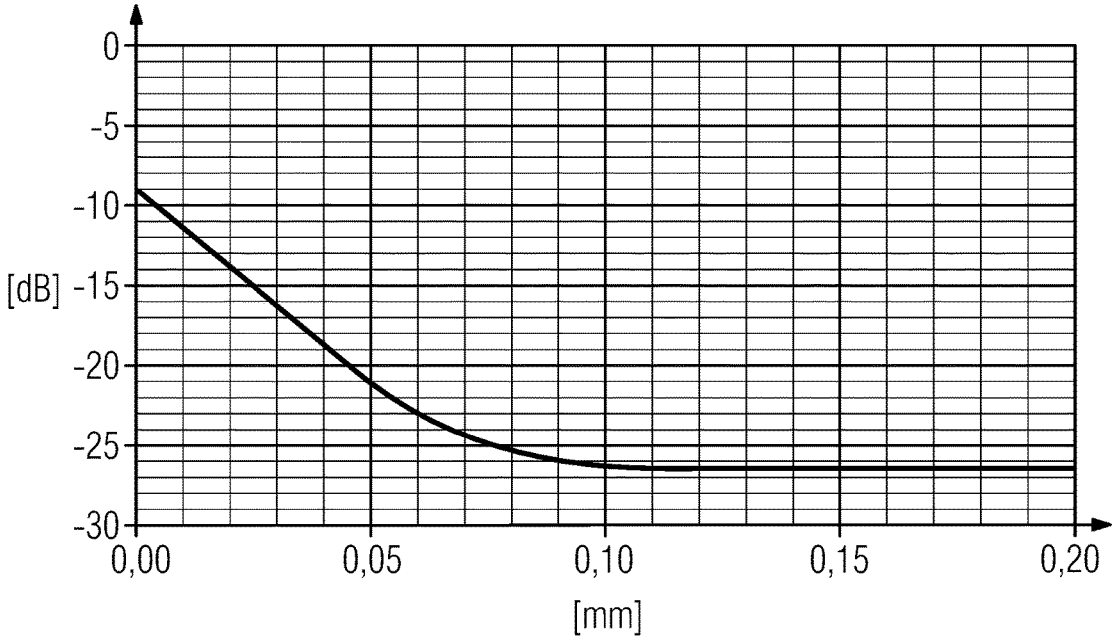
FIG. 12 shows the interference signal damping across the shielding distance.

FIG. 12 shows the damping of the interference signals of the receiver for the antenna signal as a function of the distance explained above between the shield and the coil core of the antenna. It is apparent that the damping at approximately 100 micrometers distance converges into a maximum damping. It emerges from the curve that a certain minimum distance between the shield and coil core is advantageous.

From the synopsis of the afore-cited diagrams (signal-to-noise ratio over distance, interference signal-damping over distance) it has been shown that a certain minimal distance (approx. almost 100 micrometers) between the shield and the coil core is advantageous, but that this advantage does not increase further or even reduces again with increasing distance as from a certain further distance (approx. 200 micrometers). The drive to achieve the smallest possible structure of the antenna-receiver arrangement militates against a further increase in the distance.

From the considerations mentioned above, a distance of approximately 50 to 150 micrometers between the shield and the coil core emerges as advantageous for antenna properties and installation size. It is further apparent from the diagrams that the narrower range of approx. 75 to 100 micrometers is particularly advantageous. It is apparent that according to the individual design of antenna, coil core, shield and receiver, other values may result. In constellations which are typical of hearing aids, it is however assumed that these move within the scope of the specified value ranges.

Figure 13:
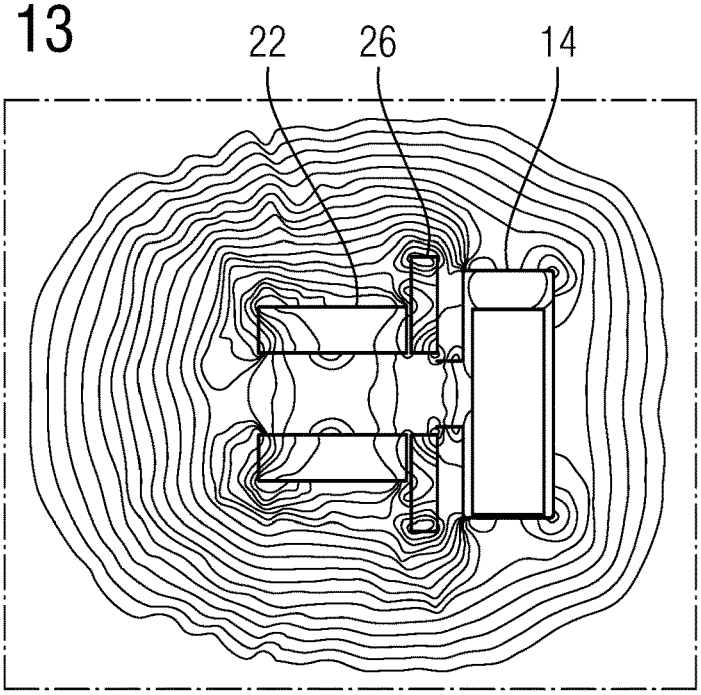
FIG. 13 shows the field line curve of the antenna field.

FIG. 13 shows a schematic representation of the magnetic field of the antenna in and around the coil core 22. Because the shield 26 is spaced apart from the coil core 22 it can be readily observed that it brings about a compression of the magnetic field on the side of the coil core 22 or antenna. On account of for its part permeable properties of the receiver 14, part of the magnetic field is also guided here through, which advantageously even brings about a theoretical extension of the antenna and thus contributes to improving the sensitivity.

It is not shown in the figure that the deformation of the field line curve by the shield 26 results in the field lines overall together running longer in the coil core 22 and shield 26. As a result, there is an advantageous increase in sensitivity. It is also apparent that a reduction in the field lines coming from the antenna develops between the shield 26 and receiver 14, because the field lines exit more strongly at the edge of the shield 26 and not somewhere between the shield 26 and receiver 14. At the same time, the shield does not have a disadvantageous effect on the scatter field.

Figure 14:
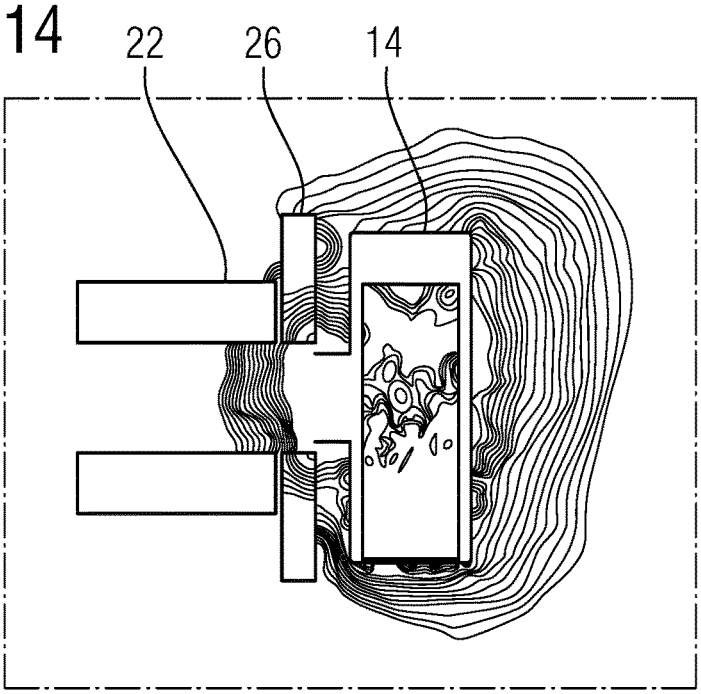
FIG. 14 shows the field line curve of the receiver field.

FIG. 14 shows a schematic representation of the magnetic field of the receiver 14. Because the shield 26 is spaced apart from the coil core 22 it can be readily observed that it brings about a shielding of the magnetic field of the receiver 14 for the antenna or the coil core 22. It is apparent that although part of the magnetic field penetrates into the shield 26, only the smallest part thereof reaches the coil core 22 across the gap.

The field lines running in the direction of the antenna 16 are deformed by the shield 26 and run here through. The field line density in the shield 26 is thus increased, whereas the field line density on the other side of the shield 26 is as a result reduced at the same time. In other words, the strength of the (magnetic) field generated by the receiver coil at the site of the coil is significant. Interference couplings from receiver signals into the antenna are thus significantly reduced.

Simulations have shown that although the field of the receiver 14 can assume a very different design over time, the good shielding effect is however essentially always kept constant.

Figure 15:
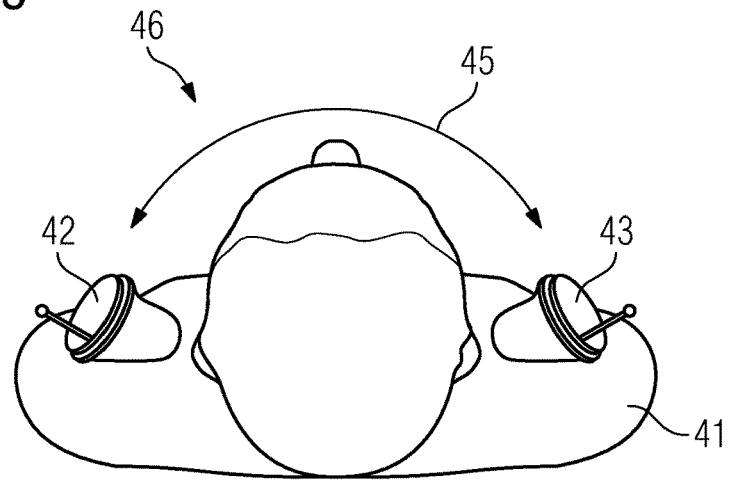
FIG. 15 shows a binaural ITE hearing aid system.

FIG. 15 schematically shows a hearing aid user 41 wearing a left ITE hearing aid 42 and a right ITE hearing aid 42. Both ITE hearing aids 42, 43 are connected via a bidirectional wireless audio data link 45 and establish a binaural ITE hearing aid system 46, wherein the audio signals received by both ITE hearing aids 42, 43 are binaurally processed into a respective output signal for the left and the right ITE hearing aid 42, 43 respectively. Both ITE hearing aids 42, 43 are similar to the ITE hearing aid 13 shown in FIG. 2 and include an antenna facility comprising a shield 26 oriented transverse to the longitudinal axis of the coil core 22 as shown in FIGS. 2-6, 8, 9, 13 and/or 14. Particularly, the wireless link for transmitting bidirectional audio data from ear-to-ear allows for use binaural signal processing algorithms such as binaural beam forming. The new binaural ITE hearing aid system provides an even more efficient solution to speech understanding in background noise. Due to the use of the aforementioned and described antenna facilities this advanced binaural technology is also possible in CIC hearing aids.

Figure 16:
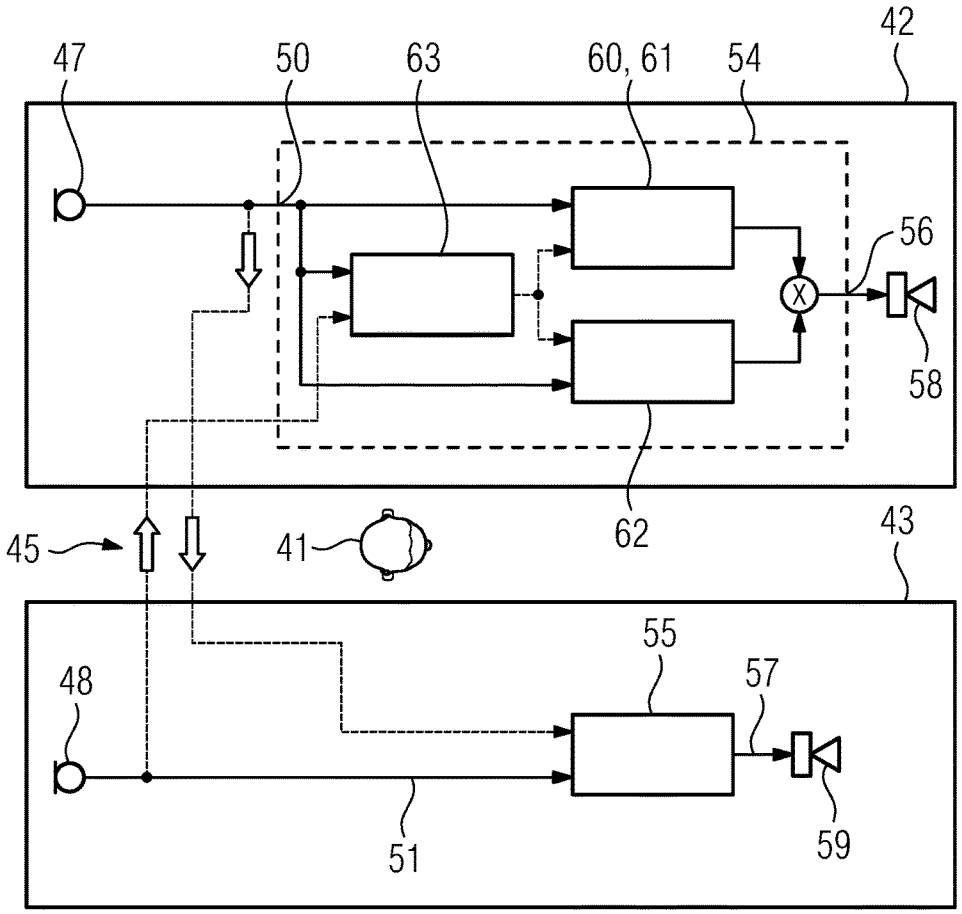
FIG. 16 shows binaural processing means in a binaural ITE hearing aid system.

FIG. 16 shows the binaural processing of the audio signals of both ITE hearings aids 42, 43 in more detail. Between the left ITE hearing aid 42 and the right ITE hearing aid 43 of the hearing aid user 41 a wireless bidirectional audio data link 45 is established.

The left ITE hearing aid 42 receives via a left input signal converter 47, particularly a microphone, a left input signal 50 which is fed into left binaural processing means 54 which processes the left input signal 47 into a left output signal 56 which is fed to a left output signal converter 58, particularly a loudspeaker. The right ITE hearing aid 43, respectively, receives via a right input signal converter 48, particularly a microphone, a right input signal 51 which is fed into right binaural processing means 55 which process the right input signal 48 into a right output signal 57 which is fed to a right output signal converter 58, particularly a loudspeaker.

Additionally, via the audio data link 45 the right input signal 51 is also transmitted to the left ITE hearing aid 42 and fed into the left binaural processing means 54. The left input signal 50 is transmitted to the right ITE hearing aid 43 accordingly and fed into the right binaural processing means 55 for further processing. Hence, the left binaural processing means 54 of the left ITE hearing aid 42 and the right binaural processing means 55 of the right ITE hearing aid 43 both process the input signals 50, 51 of both ITE hearings aids 42, 43.

The binaural processing means 54, 55 of both ITE hearing aids 42, 43 each comprise means 60 for a binaural beam forming which particularly incorporate means 61 for an adaptive beam forming, means 62 for noise reduction and means 63 for head movement compensation. The input signals 50, 51 of both ITE hearing aids 42, 43 each are processed by the binaural processing means 54 of the left ITE hearing aid 42 as well as by the binaural processing means 55 of the right hearing aid 43. The left output signal 56 of the left binaural processing means 54 and the output signal 57 of the right binaural processing means 55 are fed to the left output signal converter 58 and to the right output signal converter 59 respectively.

Figure 17:
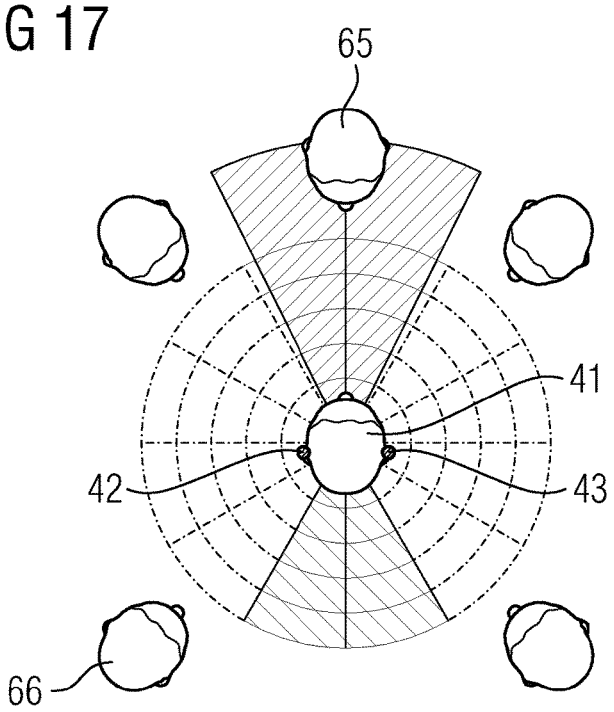
FIG. 17 shows the head shadowing effect.

FIG. 17 schematically depicts the head shadowing effect which provides a natural directivity in the left input signal 50 and in the right input signal 51 of the binaural ITE hearing aid system 45 as shown in FIGS. 15 and 16. The speech signal of a front speaker 65 is identically received without further attenuation in both ITE hearings aids 42, 43. However, the speech signal of side speakers 66 is attenuated differently by the head of the hearing aid user 41. The speech signal of a left side speaker 66 is received at the left ITE hearing aid 42 without any significant attenuation but is received at the right ITE hearing aid 43 with significant attenuation caused by the head of the hearing aid user 41. The speech signal of a right side speaker 66 is received at the right ITE hearing aid 43 without any significant attenuation but is received at the left ITE hearing aid 42 with significant attenuation caused by the head of the hearing aid user 41. In comparison to a speech signal of a front speaker 65 a speech signal from a back speaker (not shown) is received in both ITE hearing aids 42, 43 with a natural attenuation by the pinna.

Figure 18:
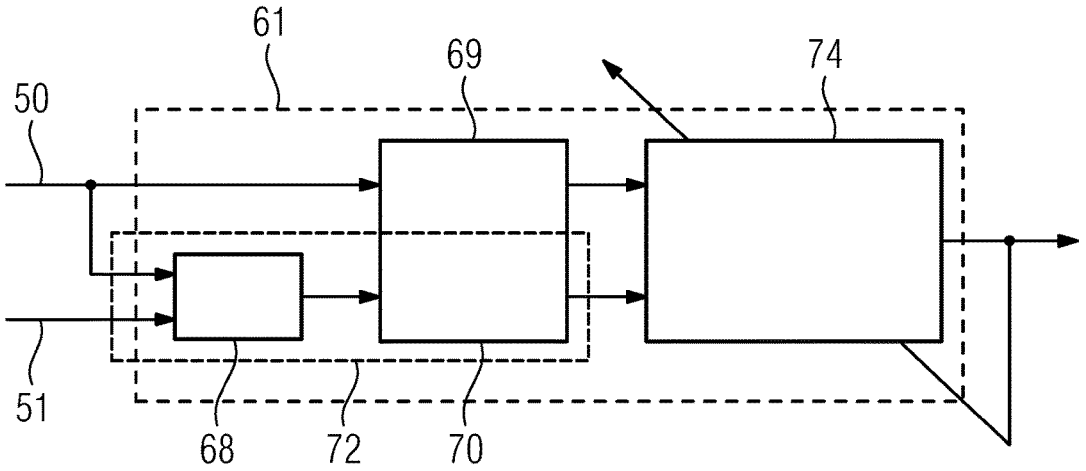
FIG. 18 shows means for an adaptive binaural beam forming and FIG. 19 shows adaptive head movement compensation.

FIG. 18 shows the means 61 for a binaural adaptive beam forming (see FIG. 16) in a left ITE hearing aid 42 in more detail. The left input signal 50 is used as the local signal. The right input signal 51 of the right ITE hearing aid 43 is used as a contra lateral signal. Both input signals 50, 51 are fed into comparator means 68 for a binaural noise and target signal estimation. Particularly, the noise signal is received by a weighted combination function of both input signals 50, 51 to yield a minimum output power. The target signal is received by a respective directional beam forming which ensures, for example, that a front target signal remains untouched or not attenuated. The target signal is formed with the aid of target estimation means 69. The noise signal is estimated in noise estimation means 70. An adaptive beam forming filter 74 updates the respective weights of the input signals 50, 51 and/or of the weights of the noise and target signals for a noise cancellation to follow quick changes in a noisy non-stationary environment.

Figure 19:
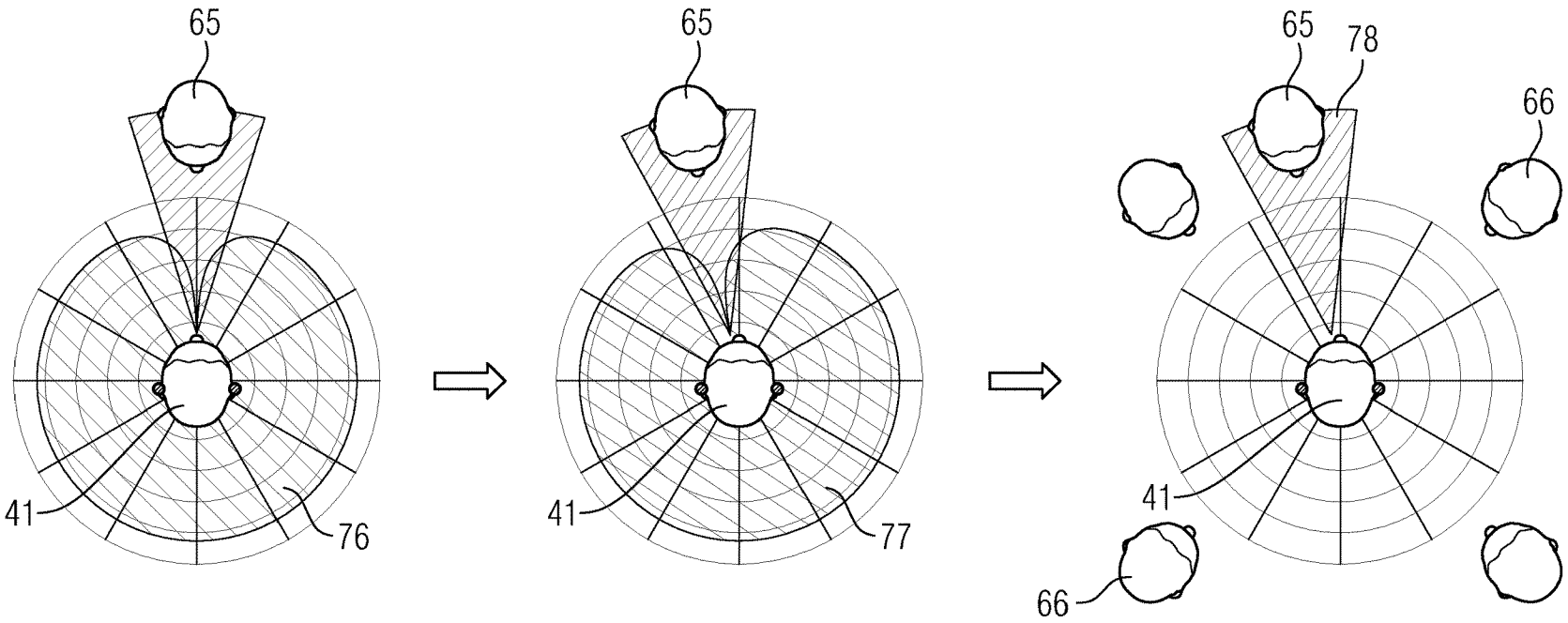

FIG. 19 shows a spatial notched directivity 76 followed from a specific combination of the left and right input signals 50, 51 of a binaural ITE hearing aid system 45 as shown in FIGS. 15 and 16. The given signal combination shows the maximal attenuation of the received audio signal (here from a front target speaker 65) and hence is a strong indication of the target signal direction. In case the front speaker 65 moves or even in case of a head movement, the combination of the input signals 50, 51 is adapted to form a rotated notched directivity 77. The narrow beam directivity 78 of the binaural ITE hearing aids system 45 is rotated accordingly and a head movement is compensated.

The following is a summary list of reference numerals and the corresponding structure used in the above description of the invention:

1 Auditory canal
2 Cartilaginous part of the auditory canal
3 ITE hearing aid
4 Receiver
5 Faceplate
6 Antenna
7 Sound channel
8 Hybrid
13 ITE hearing aid
14 Receiver
15 Faceplate
16 Antenna
17 Sound Channel
18 Hybrid
19 Housing
20 Receiver
21 Tube
22 Coil core
23 Receiver coil
24 Coil section
25 Shielding section
26, 37 Shield
31 Tube
32 Coil core
34 Receiver
36 Antenna
39, 40 Sound opening
41 Hearing aid user
42 right ITE hearing aid
43 left ITE hearing aid
45 data link
46 binaural ITE hearing aid system
47 Left input signal converter
48 Right input signal converter
50 Left input signal
51 right input signal
54 Left binaural processing means
55 Right binaural processing means
56 Left output signal
57 Right output signal
58 Left output signal converter
59 Right output signal converter
60 Means for binaural beamforming
61 Means for adaptive beamforming
62 Means for noise reduction
63 Means for head movement compensation
65 Front (target) speaker
66 Side speaker
68 Comparator
69 Target
70 Noise estimation
72 Spatial notch filter
74 Adaptive filter
76 Spatial notch
77 Rotated spatial notch
78 Narrow beam

The invention claimed is:

1. A binaural hearing aid system, comprising:
a left ITE hearing aid with an antenna facility;
a right ITE hearing aid with an antenna facility;
means for transmitting audio signals between the antenna facility of said left ITE hearing aid and the antenna facility of said right ITE hearing aid and means for binaural beam forming based on at least one of a natural directivity of a pinna of a hearing aid wearer or a head shadowing effect;
each of said antenna facilities of said left and right ITE hearing aids including:
an antenna arrangement with a coil core made of magnetically permeable material and extending along a longitudinal axis;
a further electric hearing aid component configured to emit electromagnetic interference radiation;
an at least partially planar shield made of magnetically permeable material disposed between said antenna arrangement and said further hearing aid component, said shield being arranged transversely to the longitudinal axis of said coil core and at a spacing distance of 50 to 150 micrometers from said coil core.

2. The binaural hearing aid system according to claim 1, wherein said shield is disposed at a spacing distance of between 75 and 100 micrometers from said coil core.

3. The binaural hearing aid system according to claim 1, which further comprises at least one means selected from the group consisting of means for adaptive beam forming, means for noise reduction, and means for head movement compensation.

4. The binaural hearing aid system according to claim 1, wherein said means for binaural beam forming are configured to process a left electric input signal received from a left input signal converter of said left ITE hearing aid and a right electric input signal received from a right input signal converter of said right ITE hearing aid into a left electric output signal to be transmitted to a left output signal converter of said left hearing aid and into a right output signal to be transmitted to a right signal converter of said right ITE hearing aid, each of said input signal converters being configured to convert acoustic input signals into said electric input signals, and each of said output signal converters being configured to convert said electric output signals into an acoustic output signal.

5. The binaural hearing aid system according to claim 1, wherein said means for a binaural beam forming are configured to receive a left electric input signal from said left ITE hearing aid and a right electric input signal from said right ITE hearing aid, and to combine the left input signal and the right input signal to preserve a target signal and to attenuate signals coming from directions different from a direction of the target signal, taking into consideration at least one of a natural directivity of the pinna or the head shadowing effect.

6. The binaural hearing aid system according to claim 5, wherein said means for a binaural beam forming are configured to adaptively track the direction of the target signal and to readjust a combination of the right input signal and the left input signal accordingly.

7. The binaural hearing aid system according to claim 1, wherein each of said left ITE hearing aid and said right ITE hearing aid comprises a means for binaural beam forming.

8. The binaural hearing aid system according to claim 1, wherein a material of said coil core has a lower magnetic permeability than a material of said shield.

9. The binaural hearing aid system according to claim 5, wherein said shield is made of mu-metal film.

10. The binaural hearing aid system according to claim 1, wherein said shield is glued to said antenna arrangement.

11. The binaural hearing aid system according to claim 1, wherein:

said further electric hearing aid component is configured to mainly emit the electromagnetic interference radiation in a spatial direction of interference radiation; and said antenna arrangement and said further hearing aid component are arranged transverse relative to one another to thereby reduce a coupling of interference radiation into said antenna arrangement.

12. The binaural hearing aid system according to claim 1, wherein:

antenna arrangement comprises a coil antenna;

said further hearing aid component comprises a coil arrangement configured to emit the interference radiation; and said coil antenna and said coil arrangement are oriented transverse to one another with respect to their respective longitudinal direction.

13. The binaural hearing aid system according to claim 1, wherein said further hearing aid component is affixed to said shield.

14. The binaural hearing aid system according to claim 1, wherein said shield, at least in an area of a periphery of said shield, surrounds said further hearing aid component in a direction facing away from said antenna arrangement.

15. The binaural hearing aid system according to claim 1, wherein said coil core has a sound channel and said shield has a sound opening, and the sound channel and the sound opening are aligned with one another to form a continuous sound channel.

16. The binaural hearing aid system according to claim 15, wherein the sound channel has an inner wall and wherein at least one of said inner wall or a side of said shield facing away from said coil core is covered with sound-damping material.

* * * * *